US007079803B2

(12) United States Patent
Kikuchi et al.

(10) Patent No.: US 7,079,803 B2
(45) Date of Patent: Jul. 18, 2006

(54) ELECTROPHOTOGRAPHIC PRINTER

(75) Inventors: Soushi Kikuchi, Hitachinaka (JP); Souichi Nakazawa, Hitachinaka (JP); Masahiro Mizuno, Hitachinaka (JP)

(73) Assignees: Ricoh Printing Systems, Ltd., Tokyo (JP); Hitachi Printing Solutions, Ltd., Tokyo (JP)

( * ) Notice: Subject to any disclaimer, the term of this patent is extended or adjusted under 35 U.S.C. 154(b) by 0 days.

(21) Appl. No.: 10/400,455

(22) Filed: Mar. 28, 2003

(65) Prior Publication Data

US 2003/0185609 A1 Oct. 2, 2003

(30) Foreign Application Priority Data

Mar. 29, 2002 (JP) ..... P2002-097264

(51) Int. Cl.
*G03G 15/00* (2006.01)
*G03G 15/08* (2006.01)

(52) U.S. Cl. ..... 399/396; 399/18; 399/19; 399/116; 399/401; 399/402

(58) Field of Classification Search ..... 399/116, 399/18, 401, 19, 402, 396; 347/233, 248; 118/698, 703
See application file for complete search history.

(56) References Cited

U.S. PATENT DOCUMENTS

| | | | | |
|---|---|---|---|---|
| 4,265,198 | A * | 5/1981 | Shinohara et al. | 118/695 |
| 4,800,482 | A * | 1/1989 | Hosaka et al. | 700/26 |
| 4,952,988 | A * | 8/1990 | Furuichi et al. | 399/1 |
| 5,623,331 | A * | 4/1997 | Kaneko et al. | 399/328 |
| 5,708,949 | A * | 1/1998 | Kasahara et al. | 399/330 |
| 6,014,542 | A * | 1/2000 | Hozumi et al. | 399/394 |
| 6,108,501 | A * | 8/2000 | Nagai | 399/116 |
| 6,144,811 | A * | 11/2000 | Ohori et al. | 399/9 |
| 6,185,380 | B1 * | 2/2001 | Abe et al. | 399/18 |
| 6,219,498 | B1 * | 4/2001 | Katoh et al. | 399/45 |
| 6,222,566 | B1 * | 4/2001 | Takeyama et al. | 347/116 |
| 6,405,000 | B1 * | 6/2002 | Nakaya | 399/67 |
| 6,714,758 | B1 * | 3/2004 | Miyamoto et al. | 399/384 |
| 2002/0098022 | A1 * | 7/2002 | Kabashima | 399/341 |

* cited by examiner

*Primary Examiner*—Andrew H. Hirshfeld
*Assistant Examiner*—Marvin P. Crenshaw
(74) *Attorney, Agent, or Firm*—McGuireWoods LLP

(57) ABSTRACT

A controller outputs a PRE CPF-N signal and a CPF-N signal following the PRE CPF-N signal to an electrophotographic printer. The electrophotographic printer 1 starts a predetermined preparation process in response to the PRE CPF-N signal, and starts irradiation in response to the CPF-N signal. The preparation process completes by the time of when a toner image for a first page formed on a photosensitive drum reaches a transfer point where the toner image is transferred onto a recording medium.

16 Claims, 4 Drawing Sheets

T1 ··· TIME DURATION THAT PHOTOSENSITIVE DRUM MOVES FROM EP TO TP
T2 ··· TIME DURATION REQUIRED TO BRING WEB-TRANSFER SPEED TO PROCESS SPEED

T1 ··· TIME DURATION THAT PHOTOSENSITIVE DRUM MOVES FROM EP TO TP

T2 ··· TIME DURATION REQUIRED TO BRING WEB-TRANSFER SPEED TO PROCESS SPEED

ELECTROPHOTOGRAPHIC PRINTER

BACKGROUND OF THE INVENTION

1. Field of the Invention

The present invention relates to an electrophotographic printer.

2. Related Art

There has been proposed an electrophotographic printer that forms images on a recording sheet. FIG. 1 shows main components of such an electrophotographic printer 1. When a printing process starts, first, an external controller (not shown) outputs a print start command to the electrophotographic printer 1. In response to the print start command, a photosensitive-drum driving motor 131 starts rotating a photosensitive drum 101. When the rotation speed (peripheral velocity) of the photosensitive drum 101 reaches a predetermined process speed, the controller outputs a synchronization-sheet-feed signal (hereinafter referred to as "CPF-N signal").

In response to the CPF-N signal, an irradiation process starts for irradiating a light beam onto the photosensitive drum 101 at an irradiation point EP for forming an electrostatic latent image thereon. A visible toner image corresponding to the electrostatic latent image is developed on the photosensitive drum 101, and then transferred at a transfer point TP onto a web W.

In response to the CPF-N signal, a preparation process is started also. That is, a switching motor 109 brings a pressure roller 13*c* into contact with a heat roller 13*b*, and then the rotation speed of the heat roller 13*b* is accelerated to the process speed. Also, a belt driving motor 107 rotates a web transport belt 8 so as to accelerate a web transfer speed of the web W to the process speed.

FIG. 2 shows a timing chart of the above-described preparation process. Here, a distance L is a moving distance of the photosensitive drum 101 from the irradiation point EP to the transfer point TP with respect to a rotation direction B of the photosensitive drum 101. A time T1 indicates a time duration that the photosensitive drum 101 takes to move by the distance L. The time T1 is expressed in a following equation:

$$T1=L/S$$

wherein L is the moving distance of the photosensitive drum 101 from the irradiation point EP to the transfer point TP; and S is the process speed.

As shown in FIG. 2, when a CPF-N signal is received, a control unit 120 (FIG. 5) of the electrophotographic printer 1 generates a pressure-roller driving signal (hereinafter referred to as "BR DRV-P signal") so as to bring the pressure roller 13*c* into contact with the heat roller 13*b*. Subsequently, the control unit 120 generates a sheet-feed signal (hereinafter referred to as "PAPER FEED-P signal") so as to accelerate the web transport belt 8 to the process speed. When the pressure roller 13*c* is brought into contact with the heat roller 13*b*, the control unit 120 generates a heat-roller-driving signal (hereinafter referred to as "HR ROT-P signal") so as to accelerate the rotation speed of the heat roller 13*b* to the process speed.

This preparation process in the electrophotographic printer 1 takes a time T2 and completes before the time T1 elapses after the CPF N signal was generated, that is, before the toner image developed on the photosensitive drum 101 reaches the transfer point TP.

SUMMARY OF THE INVENTION

In the above-described configuration, the time T1 shortens as the process speed S increases. However, the time T2 for completing the preparation process maintains constant regardless of the process speed S. Therefore, if the process speed S is increased more than a predetermined speed, then the time T2 becomes longer than the time T1, so that the preparation process does not complete by the time of when the toner image reaches the transfer point TP. Accordingly, it has been difficult to provide an electrophotographic printer with a process speed faster than a certain speed.

In view of foregoing, it is an object of the present invention to overcome the above problems and also to provide an electrophotographic printer with an increased process speed without changing a configuration thereof.

In order to attain the above and other objects, the present invention provides an electrophotographic printer includes a photosensitive member that rotates, a receiving means for receiving a first signal and a second signal following the first signal from a controller, a transport means for transporting a recording medium, and an irradiating means for irradiating a light beam onto the photosensitive member at an irradiating point to form an electrostatic latent image thereon. The transport means starts accelerating the recording medium to transport the recording medium at a predetermined timing such that a transport speed of the recording medium reaches a predetermined process speed within a predetermined time after the receiving means receives the second signal, and the irradiating means starts irradiating the light beam for a first page in response to the second signal.

PREFERRED EMBODIMENT OF THE PRESENT INVENTION

Figure 1:
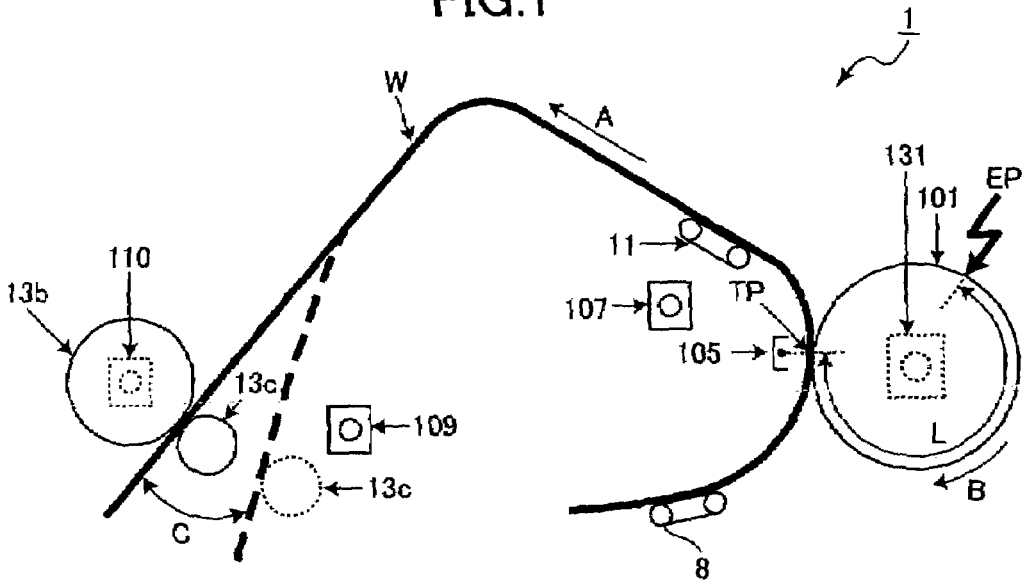
FIG. 1 is an explanatory plan view of main components of an electrophotographic printer.

Next, an electrophotographic according to an embodiment of the present invention will be described with reference to the accompanying drawings.

First, an overall configuration of the electrophotographic printer of the present embodiment will be described. Because a mechanical configuration of the electrophotographic printer of the present embodiment is the same as that of the conventional electrophotographic printer described above, the same reference numerals are used.

Figure 3:
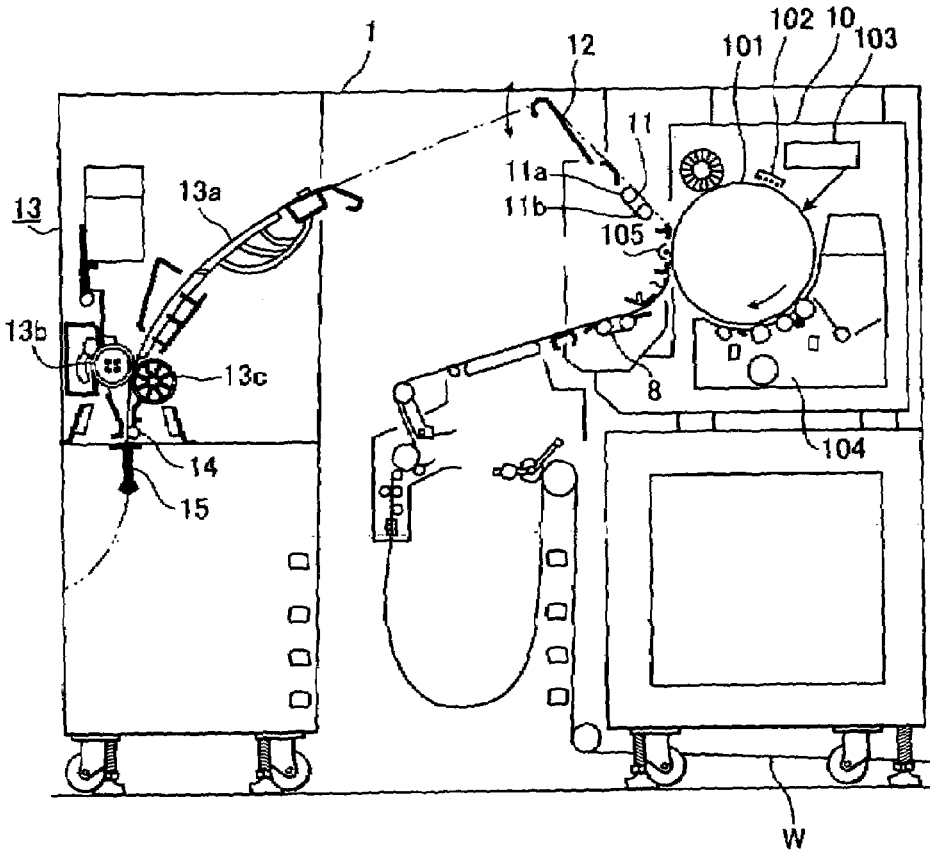
FIG. 3 is a plan view showing an internal structure of the electrophotographic printer.
Figure 2:
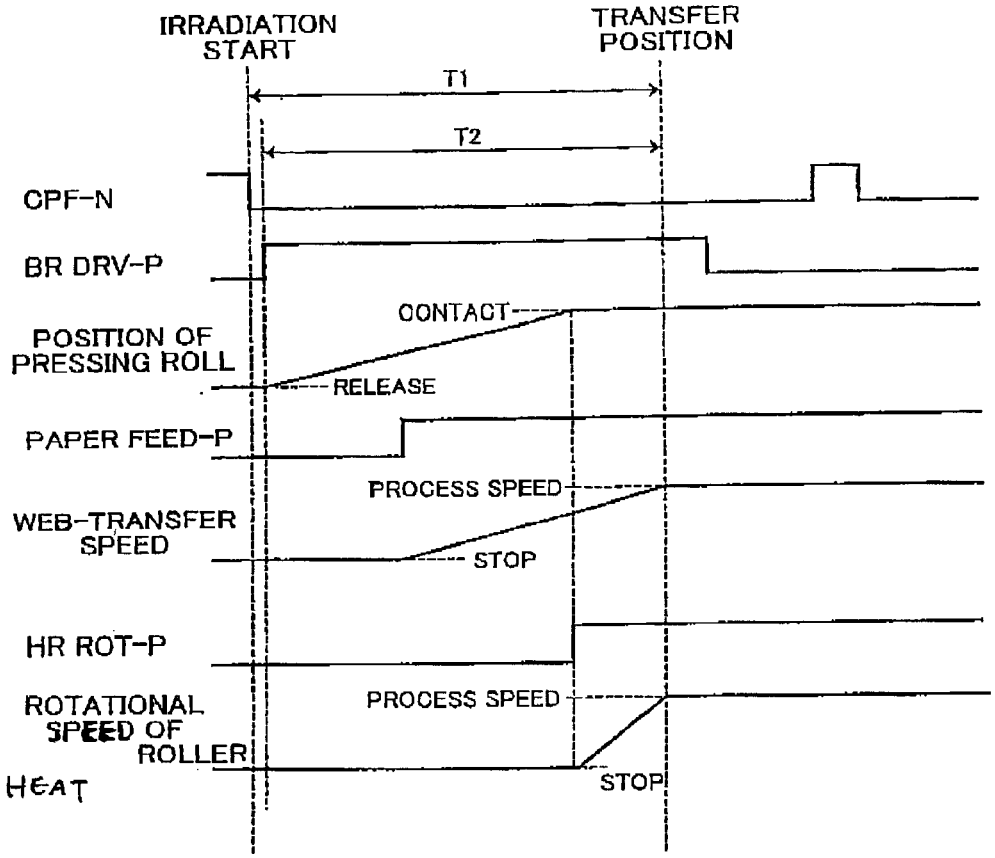
FIG.2 RELATED ART
FIG. 2 is a timing chart of a conventional preparation process.

As shown in FIG. 3, the electrophotographic printer 1 of the present embodiment includes a transport belt 8, a printing unit 10, a transport belt 11, a buffer plate 12, a fixing unit 13, a discharge roller 14, and a swing fin 15. The transport belt 11 is wound around and extending between a driving roller 11*a* and a driven roller 11*b*.

Figure 5:
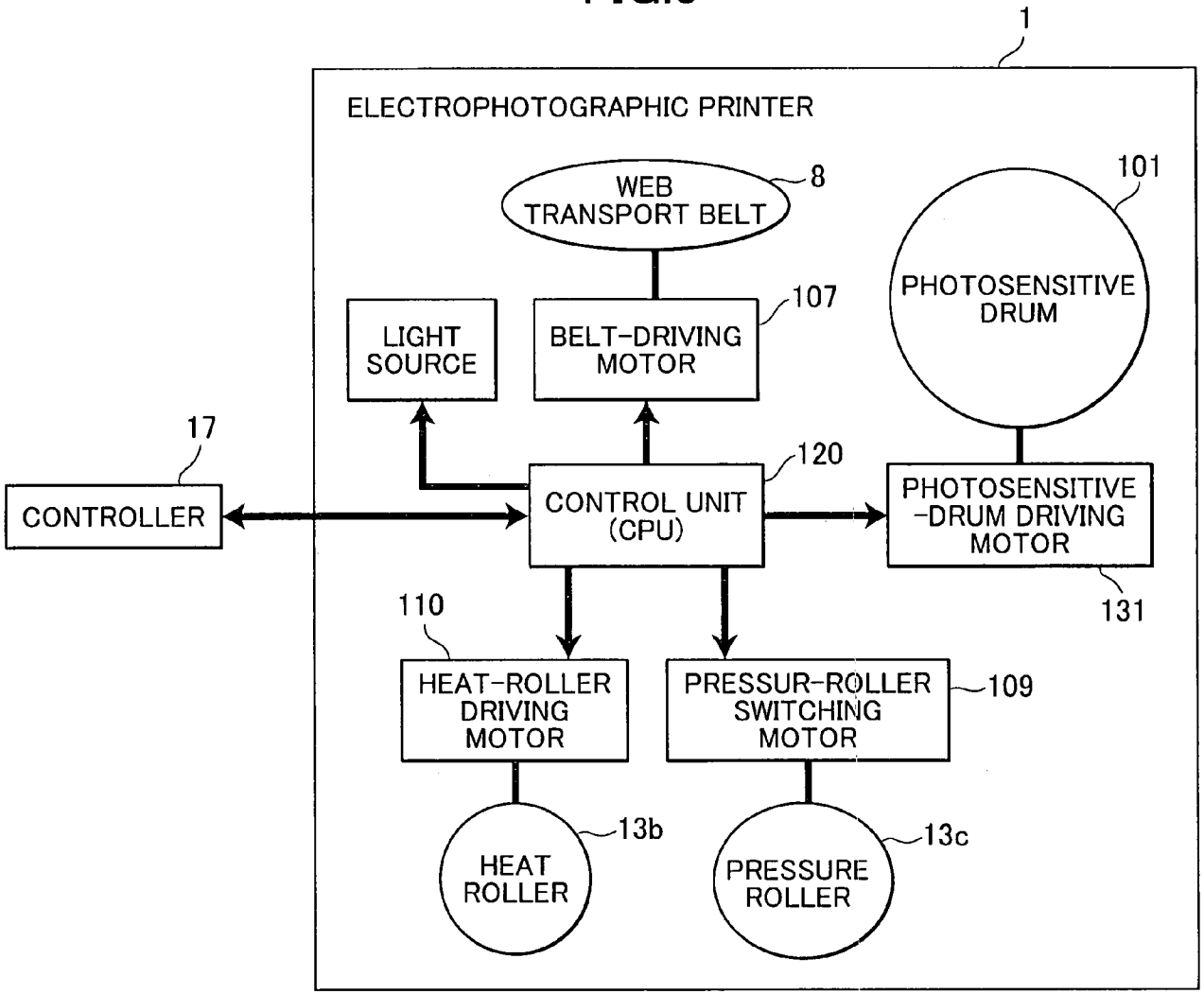
FIG. 5 is a block diagram of electrical configuration of the electrophotographic printer.

Rotation of the transport belt 8 transports a web W to the printing unit 10, which is an electrophotographic print unit. The printing unit 10 includes a photosensitive drum 101, a corona charging unit 102, a light source 103, a developing unit 104, and a transfer unit 105. When the photosensitive drum 101 starts rotating, the corona charging unit 102 is applied with a high voltage so as to uniformly charge the surface of the photosensitive drum 101. The light source 103, which is formed of a semiconductor laser or a light-emitting diode, irradiates a light beam on the photosensitive drum 101, whereby an electrostatic latent image is formed on the photosensitive drum 101. Here, the light source 103 starts irradiating a light beam for a page in response to a CPF-N signal that is repeatedly output from a controller 17 (FIG. 5).

When the electrostatic latent image comes into confrontation with the developing unit 104, a visible toner image corresponding to the electrostatic latent image is developed on the photosensitive drum 101. Thus developed toner image is transferred onto a surface of the web W by the transfer unit 105 having an opposite polarity from that of the toner image. The web W with the toner image transferred thereon is supplied onto the transport belt 11, and further transported along the buffer plate 12. Although not shown in the drawings, there is provided a suction member that enables the transport belt 11 to transport the web W with its rear surface attached to the transport belt 11 by generating suctioning force. Then, the web W reaches the fixing unit 12.

The fixing unit 13 includes a pre-heater 13*a*, a heat roller 13*b*, and a pressure roller 13*c*. The pressure roller 13*c* swings back and forth in a direction C (FIG. 1) so as to selectively contact and detached from the heat roller 13*b*. During printing operations, the pressure roller 13*c* presses against the heat roller 13*b*, thereby defining a nip portion therebetween. The web W having reached the fixing unit 13 is preheated by the pre-heater 13*a*, and then further transported through the nip portion between the heat roller 13*b* and the pressure roller 13*c*. At this time, the toner image is thermally fused onto the web W.

Figure 4:
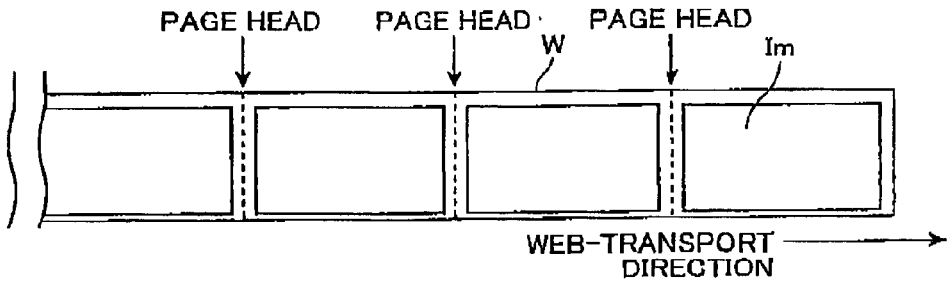
FIG. 4 is a plan view of a web printed with images.

The web W discharged from the fixing unit 13 is further transported to the discharge roller 14 and folded back and forth into an accordion fold by the swing movement of the swing fin 15 and stored in the electrophotographic printer 1. In this manner, as shown in FIG. 4, a toner image Im is printed on each page of the web W.

Here, the pressure roller 13*c* is maintained separated from the heat roller 13*b* unless the web W is being transported even during printing operations. This is because the heat roller 13*b* is maintained at a high temperature for fusing toner. If the pressure roller 13*c* keeps pressing against the heat roller 13*b*with the web W being interposed therebetween, the web W would get burned, turning into brownish or yellowish in its color.

FIG. 5 is a block diagram showing an electrical configuration of the electrophotographic printer 1. As shown in FIG. 5, the electrophotographic printer 1 further includes the control unit 120, a belt-driving motor 107, a heat-roller driving motor 110, a pressure-roller switching motor 109, and a photosensitive-drum driving motor 131, all connected to one another. The control unit 120 is also connected to an external controller 17. Here, the controller 17 and the electrophotographic printer 1 together define a print system 100.

The control unit 120 performs an overall control of the electrophotographic printer 1. The belt-driving motor 107 is for driving the transport belt 8 to rotate. The heat-roller driving motor 110 is for driving the heat roller 13*b* to rotate, and the pressure roller switching motor 109 is for switching a position of the pressure roller 13*c* into and out of contact with the heat roller 13*b*. The photosensitive-drum driving motor 131 is for controlling the photosensitive drum 101 to rotate.

Figure 6:
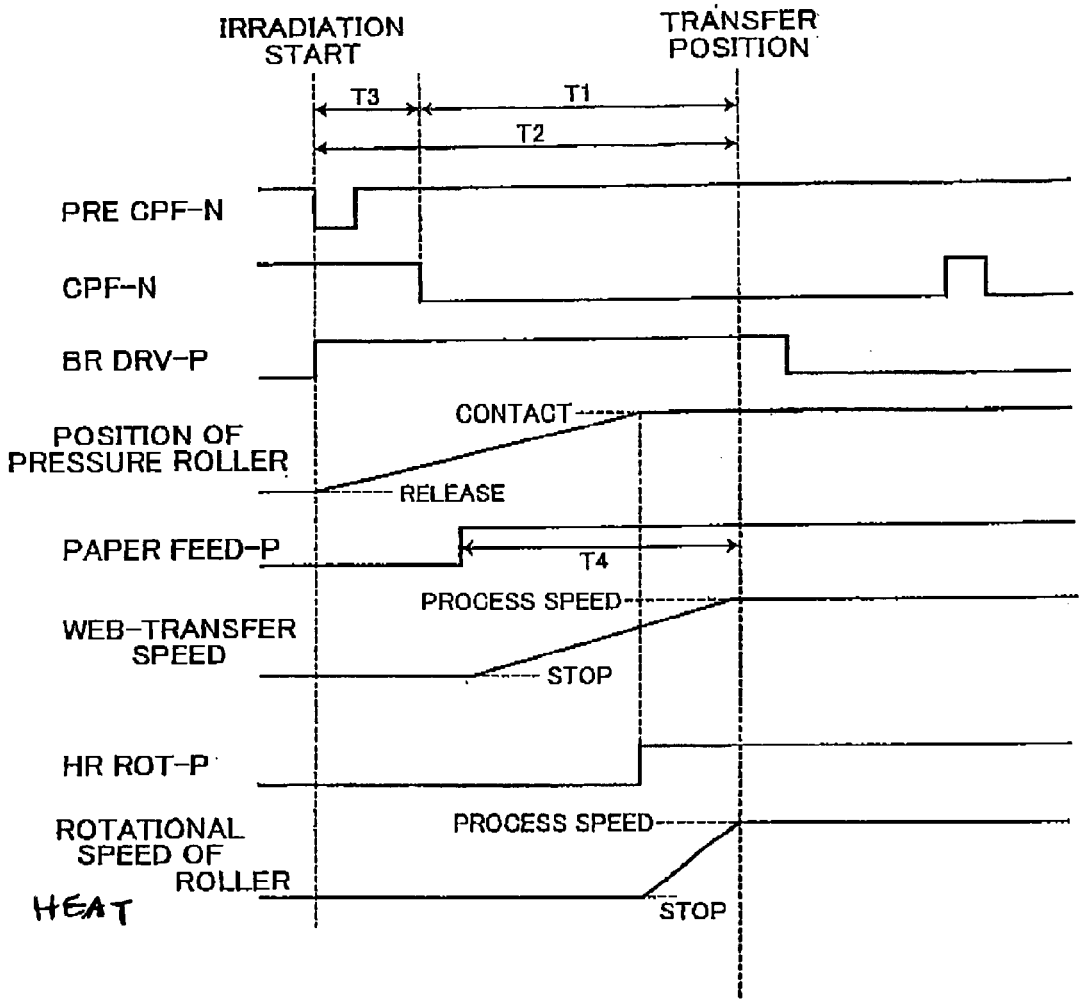
FIG. 6 is a timing chart of a preparation process according to an embodiment of the present invention.

Next, a process of the present embodiment will be described with reference to a timing chart of FIG. 6.

When the controller 17 outputs a print start command to the control unit 120, the control unit 120 controls the photosensitive-drum driving motor 131 to start rotating the photosensitive drum 101. After the rotation speed (peripheral velocity) of the photosensitive drum 101 reaches a predetermined process speed, then the electrophotographic printer 1 enters a standby mode, that is, the electrophotographic printer 1 is ready for start printing. When the electrophotographic printer 1 enters a stand-by mode, the control unit 120 outputs a wait-OFF signal to the controller 17, notifying the controller 17 of the standby mode of the electrophotographic printer 1.

After receiving the wait-OFF signal, the controller 17 outputs a PRE CPF-N signal to the control unit 120. Upon reception of the PRE CPF-N signal, a preparation process starts. That is, in synchronization with a lowering edge of the PRE CPF N signal, the control unit 120 outputs a BR DRV-P signal to the pressure-roller switching motor 109, controlling the pressure-roller switching motor 109 to bring the pressure roller 13*c* into contact with the heat roller 13*b*.

When a time T3 elapses after outputting the PRE CPF-N signal, the controller 17 outputs a CPF-N signal. In response to the CPF-N signal, the control unit 120 controls the light source 103 to start irradiating a light beam onto the photosensitive drum 101. Thereafter, the control unit 120 outputs a PAPER FEED-P signal to the belt-driving motor 107, so that the belt-driving motor 107 drives the transport belt 8 to start accelerating the web W.

When the pressure roller 13*c* is completely brought into contact with the heat roller 13*b*, then the control unit 120 outputs a HR ROT-P signal to the heat-roller driving motor 110, so that the heat-roller drive motor 110 starts driving the heat roller 13*b* to rotate. The heat roller 13*b* starts rotating only after the pressure roller 13*c* has completely brought into contact with the heat roller 13*b* because bringing the pressure roller 13*c* into contact with the heat roller 13*b* that is being rotating damages toner images formed on the web W.

Then, the web transport speed of the web W and the rotation speed of the heat roller 13*b* both reach the predetermined process speed, and the preparation process completes by the time of when a toner image that has been developed on the photosensitive drum 101 reaches the transfer point TP.

Here, the time T3 is determined by the following equation:

$$T3-T2\ T1$$

wherein T2 is a time from when the BR DRV-P signal is generated until the preparation process completes; and T1 is a time that the photosensitive drum 101 takes to rotate by the distance L, which is from the irradiation point EP to the transfer point TP.

The time T2 is specific to the electrophotographic printer 1 and varies among products. Therefore, it is necessary to obtain the time T2 for a particular electrophotographic printer and determine a corresponding time T3 beforehand, and to store data relating to the time T3 to a storage are (not shown) of the controller 17.

A time T4 required to accelerate the web transport speed to the process speed is also specific to each electrophotographic printer. Therefore, data relating to the time T4 is stored in a memory (not shown) of the electrophotographic printer 1, and the control unit 120 outputs the PAPER FEED-P signal at a timing that is the time T4 before the toner image reaches the transfer point TP.

As described above, according to the present embodiment, it is possible to accelerate the web transport speed to the predetermined process speed by the time of when the toner image reaches the transfer point TP even when the time duration T1 is shorter than the time T2 ithout changing mechanical configuration of the electrophotographic printer 1.

Also, because T3=T2−T1, time delay is minimized. That is, although it is possible to make the time T3 longer than the time difference between the time T2 and time T1, this will delay process start timing. Therefore, if the printing is intermittently performed, then the total time delay will accumulatively increased, thereby decreasing overall process speed.

While some exemplary embodiments of this invention have been described in detail, those skilled in the art will recognize that there are many possible modifications and variations which may be made in these exemplary embodiments while yet retaining many of the novel features and advantages of the invention.

For example, in the above described embodiment, the PRE CPF-N signal differing from the CPF-N signal is generated. However, a first CPF-N signal could be used as a PRE CPF-N signal.

What is claimed is:

1. An electrophotographic printer comprising:

a photosensitive member that rotates;

means for receiving a first signal and a second signal following the first signal from a controller;

means for transporting a recording medium, wherein the transport means starts accelerating the recording medium to transport the recording medium at a predetermined timing such that a transport speed of the recording medium reaches a predetermined process speed within a predetermined time in response to the second signal; and means for irradiating a light beam onto the photosensitive member at an irradiating point to form an electrostatic latent image thereon, wherein the irradiating means starts irradiating the light beam for a first page in response to the second signal.

2. The electrophotographic printer according to claim 1, further comprising means for developing a toner image corresponding to the electrostatic latent image on the photosensitive member, and means for transferring the toner image from the photosensitive member onto the recording medium at a transfer point, wherein the transport means accelerates the recording medium to the predetermined process speed by the time of when the toner image for the first page on the photosensitive member reaches the transfer point.

3. The electrophotographic printer according to claim 1, further comprising:

means for fixing a toner image onto the recording medium, wherein the fixing means comprises a heat member, and a pressure member; and a control means for selectively bringing the pressure member into and out of contact with the heat member, wherein the control means brings the pressure member into contact with the heat member in response to the first signal.

4. The electrophotographic printer according to claim 3, further comprising means for developing a toner image corresponding to the electrostatic latent image on the photosensitive member, and means for transferring the toner image from the photosensitive member onto the recording medium at a transfer point, wherein the transport means accelerates the recording medium to the predetermined process speed by the time of when the toner image for the first page on the photosensitive member reaches the transfer point.

5. The electrophotographic printer according to claim 4, wherein the control means further controls the heat roller to rotate, the control means accelerating a rotation speed of the heat roller to the predetermined process speed by the time of when the toner image for the first page on the photosensitive member reaches the transfer point, the control means starting accelerating the rotation speed after the pressure member has completely been brought into contact with the heat member.

6. The electrophotographic printer according to claim 5, wherein the recording medium is a web having an elongated length.

7. A print system comprising:

a controller that outputs a first signal and a second signal following the first signal; and the electrophotographic printer of claim 1.

8. The electrophotographic printer according to claim 1, further comprising means for developing a toner image corresponding to the electrostatic latent image on the photosensitive member, and means for transferring the toner image from the photosensitive member onto the recording medium at a transfer point, wherein the first signal is output from the controller a predetermined time before the second signal is output such that the transport means accelerates the recording medium such that the transport speed of the recording medium reaches the predetermined process speed by the time of when the electrostatic latent image formed on the photosensitive member by the irradiating means in response to the second signal reaches the transfer point.

9. An electrophotographic printer comprising:

a photosensitive member that rotates;

a control unit that receives a first signal and a second signal following the first signal from a controller;

a transport unit that transports a recording medium, wherein the transport unit starts transporting the recording medium in response to the second signal and accelerating the recording medium to transport the recording medium at a predetermined timing such that a transport speed of the recording medium reaches a predetermined process speed within a predetermined time; and a light source that irradiates a light beam onto the photosensitive member at an irradiating point to form an electrostatic latent image thereon, wherein the light source starts irradiating the light beam for a first page in response to the second signal.

10. The electrophotographic printer according to claim 9, further comprising:

a developing unit that develops a toner image corresponding to the electrostatic latent image on the photosensitive member; and a transfer unit that transfers the toner image from the photosensitive member onto the recording medium at a transfer point, wherein the transport unit accelerates the recording medium to the predetermined process speed by the time of when the toner image for the first page on the photosensitive member reaches the transfer point.

11. The electrophotographic printer according to claim 9, further comprising:

a fixing unit that fixes a toner image onto the recording medium;

wherein the fixing unit includes a heat member and a pressure member, and the control unit selectivity brings the pressure member into and out of contact with the heat member, and brings the pressure member into contact with the heat member in response to the first signal.

12. The electrophotographic printer according to claim 11, further comprising:

a developing unit that develops a toner image corresponding to the electrostatic latent image on the photosensitive member; and a transfer unit that transfers the toner image from the photosensitive member onto the recording medium at a transfer point, wherein the transport unit accelerates the recording medium to the predetermined process speed by the time of when the toner image for the first page on the photosensitive member reaches the transfer point.

13. The electrophotographic printer according to claim 12, wherein the controlunit further controls the heat roller to rotate, the control unit accelerating a rotation speed of the heat roller to the predetermined process speed by the time of when the toner image for the first page on the photosensitive member reaches the transfer point, the control unit starting accelerating the rotation speed after the pressure member has completely been brought in to contact with the heat member.

14. The electrophoto graphic printer according to claim 13, wherein the recording medium is a web having an elongated length.

15. The electrophotographic printer according to claim 9, further comprising:

a developing unit that develops a toner image corresponding to the electrostatic latent image on the photosensitive member; and a transfer unit that transfers the toner image from the photosensitive member onto the recording medium at a transfer point, wherein the first signal is output from the controller at a predetermined time before the second signal is output such that the transport unit accelerates the recording medium such that the transport speed of the recording medium reaches the predetermined process speed by the time of when the electrostatic latent image formed on the photosensitive member by the light source in response to the second signal reaches the transfer point.

16. A print system comprising:

a controller that outputs a first signal and a second signal following the first signal; and the electrophotographic printer of claim 9.

* * * * *